United States Patent [19]

Nord

[11] Patent Number: 4,479,345

[45] Date of Patent: Oct. 30, 1984

[54] CORRUGATED BOX FORMING, LOADING AND SEALING MACHINE

[75] Inventor: Keith W. Nord, Stillwater, Minn.

[73] Assignee: Ex-Cell-O Corporation, Troy, Mich.

[21] Appl. No.: 343,675

[22] Filed: Jan. 28, 1982

[51] Int. Cl.[3] ..... B65B 43/30

[52] U.S. Cl. ..... 53/564; 53/253; 53/374; 53/383; 493/163; 493/183

[58] Field of Search ..... 53/253, 374, 382, 383, 53/564, 565, 566, 574; 493/163, 164, 172, 318, 183

[56] References Cited

U.S. PATENT DOCUMENTS

| | | | |
|---|---|---|---|
| 1,791,963 | 2/1931 | Howard et al. | 493/163 |
| 2,744,373 | 5/1956 | Hull et al. | 53/374 |
| 3,225,666 | 12/1965 | Reimers | 493/164 |
| 3,486,423 | 12/1969 | Mistarz | 53/565 X |
| 3,579,958 | 5/1971 | Hentges | 53/379 X |
| 3,619,979 | 11/1971 | Martensson et al. | 53/565 |
| 3,626,661 | 12/1971 | Reichert et al. | 53/564 X |
| 3,808,770 | 5/1974 | Berney | 53/374 X |
| 3,842,571 | 10/1974 | Focke et al. | 53/564 |

*Primary Examiner*—Robert L. Spruill
*Assistant Examiner*—Steven P. Weihrouch
*Attorney, Agent, or Firm*—John P. Moran

[57] ABSTRACT

There is illustrated and described a machine for setting up corrugated box blanks having four side panels folded double and sealed along their otherwise adjacent free edges and having top and bottom end flaps extending from each end of each side panel. The machine includes a magazine for holding a plurality of folded blanks, means for removing individual blanks from the magazine and opening same into vertically oriented four-sided tubes, first transfer means for moving the tubes laterally while closing the bottom leading end flap, means for closing the bottom trailing end flap, breaking the bottom side flaps and rotating the open-topped boxes to a loading position, separate, cooperating loading means for depositing product, such as cartons, bottles or the like, into the open-topped boxes, second transfer means for moving the loaded boxes laterally while closing the top leading and trailing end flaps and bringing the top side flaps into contact with converging rails, means for depositing an adhesive along each of the top and bottom oppositely disposed side flaps while the boxes are being moved, and means for compressing, and thus sealing, the top and bottom side flaps onto the respective leading and trailing end flaps, readying the boxes for discharge.

9 Claims, 3 Drawing Figures

CORRUGATED BOX FORMING, LOADING AND SEALING MACHINE

TECHNICAL FIELD

This invention relates generally to paperboard forming, loading and sealing machines and, more particularly, to such machines for forming from a blank, loading with a product, and sealing corrugated boxes.

BACKGROUND ART

Heretofore, various machine arrangements have been proposed and used to form, load and fill containers, such as corrugated boxes, from blanks which are manufactured and shipped in a flat state, wherein the first and fourth side panels are glued together along their adjacent edges, and the top and bottom flaps are extended outwardly as extensions of each end of the respective four side panels, connected to the latter by the usual unbroken score lines.

DISCLOSURE OF THE INVENTION

It is a general object of this invention to provide an improved corrugated box forming, loading and sealing machine for use with a conventional suitable "caser" or product filling machine, the latter serving to lower, say, twelve liquid carrying paperboard cartons into the corrugated box being formed by the machine of the present invention.

Another object of the invention is to provide an improved compact and efficient corrugated box forming, loading and sealing machine.

A further object of the invention is to provide a box forming, loading and sealing machine, including (1) a magazine for holding corrugated box blanks sealed at their vertical edges so as to form double thick blanks with side panels 1 and 2 and their respective end panels adjacent side panels 4 and 3 and their respective end panels, panels 1 and 4 being joined together, (2) an opening means for opening the blank into a rectangular or square cross-section tube, (3) means for closing the leading and trailing minor bottom flaps while the tube is being conveyed, (4) a loading section for the loading of product by a suitable caser into the partially formed tube, (5) a rotator for rotating the loaded, partially formed tube from one direction to a direction perpendicular thereto, (6) means for closing the leading and trailing minor top flaps, (7) means for gluing and closing the major or longitudinal top and bottom flaps to complete the formation of the corrugated box as a filled package, and (8) means for compressing and discharging the sealed box.

These and other objects and advantages of the invention will be apparent when reference is made to the following description and accompanying drawings.

BEST MODE OF CARRYING OUT THE INVENTION

Figure 1:
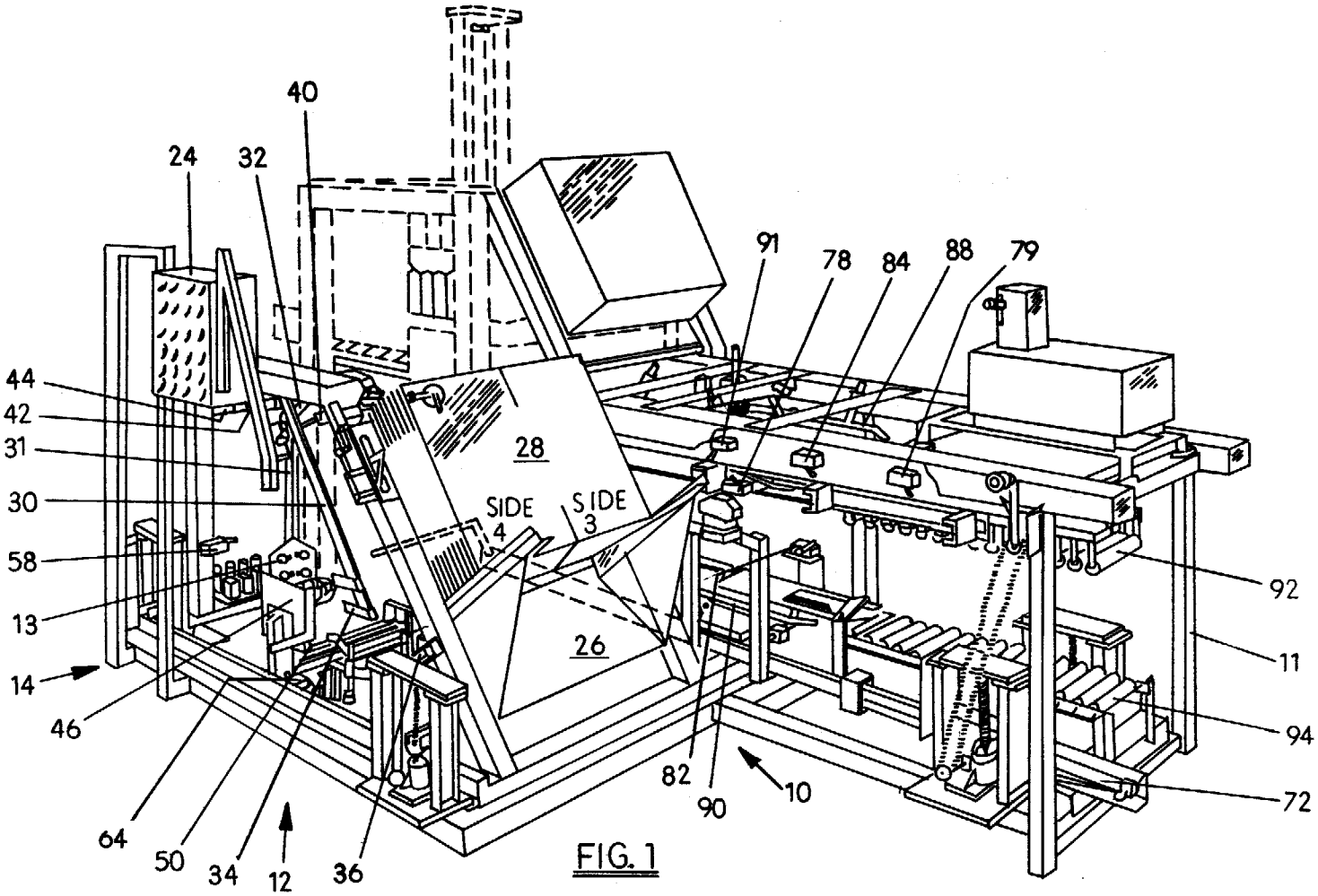
FIG. 1 is a perspective view from the infeed side of the inventive machine.
Figure 2:
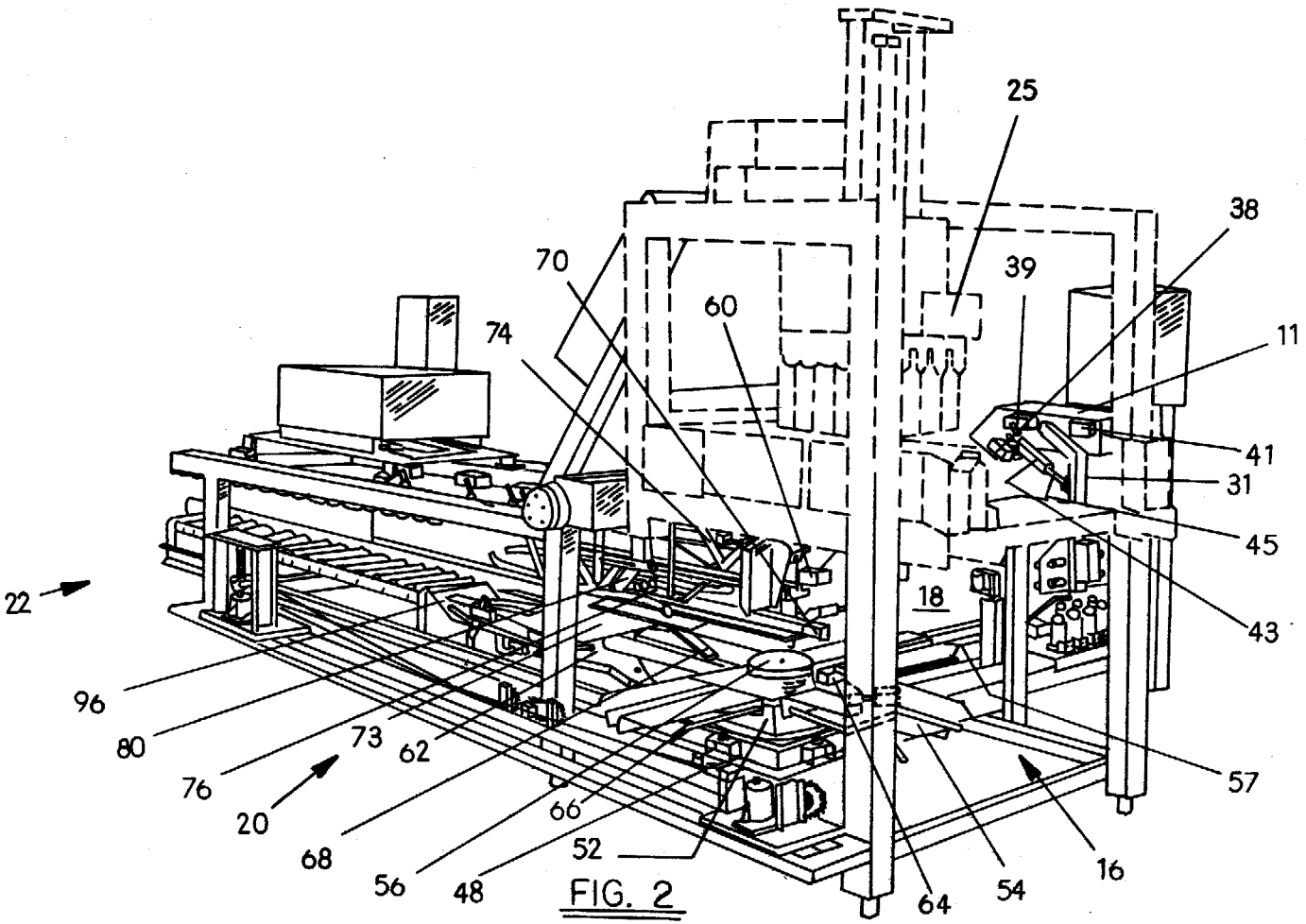
FIG. 2 is a perspective view from the discharge side of the inventive machine.

Referring now to the drawings in greater detail, FIGS. 1 and 2 illustrate a corrugated box forming, loading and sealing machine 10 mounted within suitable framework 11 and generally including a corrugated box blank infeed section 12, a blank opening section 14, a minor bottom flaps closing section 16, a loading section 18, a major bottom flaps and minor and major top flaps closing and gluing section 20, a compressing and discharging section 22, a control panel 24, and an overhead "caser" or loading machine 25.

The infeed section 12 includes a magazine 26 capable of holding a predetermined number of case blanks 28, and an opener arm 30 pivotally mounted on a pivot pin 32. Each blank 28 includes four side panels indentified hereinafter as sides 1, 2, 3 and 4. A pair of spaced suction cups 34 are secured to the opener arm 30 and adapted to contact side 1 of the front blank 28, as will be explained.

A limit switch 36 is mounted on the magazine 26 and a pair of limit switches 38 and 40 are mounted on the framework 11 and positioned so as to be alternately contacted by the opener arm 30. A suitable cylinder means 42 is connected by a piston rod 44 to the arm 30 and is operatively connected to the limit switch 36.

Another pair of limit switches 39 and 41 (FIG. 2) are mounted on the framework 11 and positioned so as to be alternately contacted by a swing arm 31 bearing vacuum cups 13. A suitable cylinder means 43 is connected by a position rod 45 to the swing arm 31. A loading pusher plate 46 (FIG. 1) is urged forward by suitable cylinder means 48 (FIG. 2) once the swing arm 31 contacts the limit switch 41. A projecting arm 50 is mounted on the bottom center of the pusher plate 46, extending forwardly therefrom for contacting and extending beneath the trailing bottom flap of each case blank 28.

A rotator 52 includes four 90° spaced support arms 54 extending from a central hub member 56. The support arm 54 which is aligned with the projecting arm 50 serves to bend the leading bottom flap of the case blank 28 as the latter is pushed onto the aligned support arm 54 by the loading pusher plate 46 moving along a track 57. A limit switch 58 is operatively connected to the cylinder means 43 and mounted on the framework 11 such that it is actuated by movement of the tubular case therepast, while a limit switch 60 is mounted on the framework so as to be contacted by the leading side of the tubular case. Suitable cam means 62 is actuated by the limit switch 60, causing the rotator 52 to rotate through one 90° index. After two more such indexes, the respective partially bottom-folded cases will have been moved from the receiving position to a discharge position 270° away.

Release of the limit switch 60 as a result of the rotation of the rotator 52 and associated cases actuates the cylinder means 48, causing the pusher plate 46 to retract along the track 57 into contact with a limit switch 64, to be retained until the next blank 28 is swung into contact with the limit switch 58.

As may be noted in FIG. 2, a pair of converging guide rails 66 is mounted directly beneath each support arm 54 and positioned so as to be contacted by the side bottom major flaps of each case as it is pushed onto the respective support arm 54.

Figure 3:
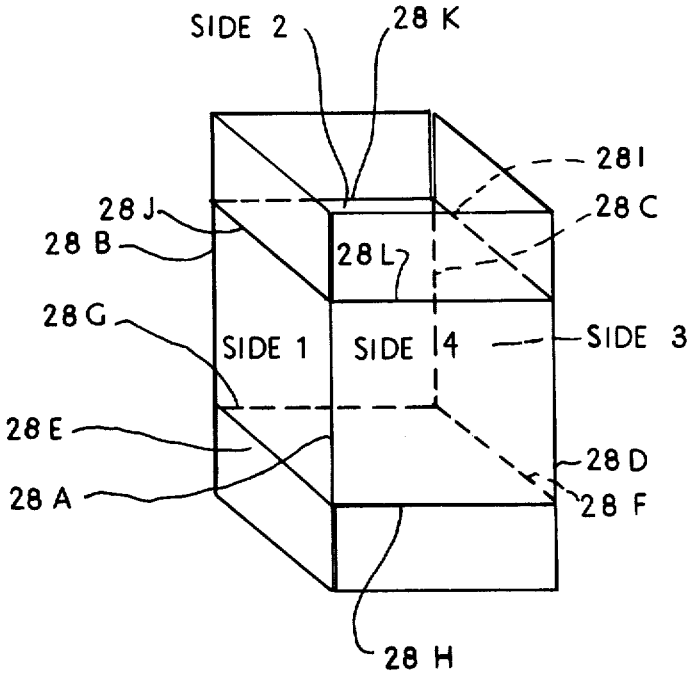
FIG. 3 is a perspective view of a partially formed corrugated container of the type which is processed by and through the inventive machine illustrated in FIGS. 1 and 2.

At the above referenced 270° discharge position, the partially bottom-closed case is positioned with its side panel 3 trailing and facing a discharge pusher plate 68, and in contact with a limit switch 70 mounted on the framework 11. The limit switch 70 is operatively connected to a suitable cylinder means 72 (FIG. 1) for causing the overhead "caser" 25 to lower and for moving the pusher plate 68 forward, moving the loaded box onto and along a stationary platform 73. An arm 74 extends forwardly from the framework 11, serving to bend the trailing top minor flap about the scoreline **28*i* (FIG. 3). A stationary rail 76 is located downstream of the case such that it is contacted by the leading top minor flap and bent about the scoreline 28*j* (FIG. 3**).

A limit switch 79 is mounted on the framework 11 so as to be contacted by the discharge pusher plate 68 while the latter is on its forward stroke. A limit switch 78 is operatively connected to upper and lower sets of glue guns 80. Still another limit switch 82 is mounted on a lower portion of the framework 11 such that it is actuated by a passing case and must be engaged before the limit switch 78 can be effective. A further limit switch 84 is located downstream of the switches 78 and 82, a predetermined distance before the end of the forward stroke of the discharge pusher plate 68.

Two sets of upper and lower rails 88 and 90 diverge at their forward ends toward the rotator 52 and then straddle the discharge passage through the gluing station to converge at their rear ends apart from upper and lower conveyor rollers 92 and 94, respectively. A ramp 96 (FIG. 2) is located just ahead of the lower rollers 94, intermediate the latter and the lower rails 90.

OPERATION

Once the machine 10 is turned on by operator actuation of the control panel 24, with no case blank 28 in contact with the limit switch 36, the opener arm 30 is caused to swing about the pivot pin 32 by the cylinder means until the suction cups 34 come into contact with side panel 1 of the first case blank 28 in the magazine 26, while the arm 30 simultaneously contacts the limit switch 40. Actuation of the latter causes the arm 30 to swing back to its original position, pulling the case blank 28 out of the magazine and thereby opening the blank into a square or rectangular tube, as shown in FIG. 3. More specifically, this is accomplished by bending side panels 1, 2 and 3 of the case blank 28 about the vertical corner scorelines **28*a*, 28*b*, 28*c*, and 28*d*. Side panel 4 is stationary, without being rotated 90° in the manner of side panels 1 and 3, or swung in an arc in the manner of side panel 2. When the tube is rectangular rather than square, side panels 2 and 4 are wider than side panels 1 and 3. Thereafter, side panel 3 will lead, side panel 1 will trail while being pushed onto the aligned support arm 54, and side panels 2 and 4** will travel in parallel lines therebetween.

At the end of the cylinder 43 stroke, the swing arm 31 contacts both (1) the limit switch 41 to hold the arm 31 and the tube in this position and (2) the limit switch 58 to cause the loading pusher plate 46 to move forward on the track 57, moving the tube forward. A projecting support arm 50 on the front of the pusher plate urges the trailing bottom flap forward about horizontal scoreline **28*e*. As the tube is pushed forward, the leading bottom minor flap contacts the distal end of the aligned support arm 54 of the rotator 52, causing the flap to be bent about the horizontal scoreline 28*f*, toward the other or trailing bottom minor flap. The tube is thus moved onto the first of the four 90° spaced support arms 54 of the rotator 52. The pair of converging rails 66 just beneath the sides of each support arm 54 serve to "break" the side bottom major flaps about the horizontal scorelines 28*g* and 28*h***.

As the tube is moved toward the rotator 52, its side panel 3 contacts the limit switch 60 which is held for the remainder of the stroke as side panel 2 moves therepast. This causes the rotator 52 to rotate 90°, carrying the tube away from the switch 60, causing the loading pusher plate 46 to retract. As the latter retracts, it contacts the limit switch 64 which serves to retain the pusher plate in position until a next blank 28 is swung into contact with the limit switch 58 to repeat the cycle just described.

Once four partially bottom-formed cases 28 have been rotated by the four support arms 54 of the rotator 52, the first of the four cases is rotated into position in front of the discharge pusher plate 68 such that side panel 1 is now leading. Upon being retracted into contact with the limit switch 70, the caser 25 is caused to lower a full load of product, such as paperboard cartons, plastic jugs, or glass bottles, or the like, into the case, and the discharge pusher plate 68 is caused to engage side panel 3 and move toward the discharge end of the machine.

As the discharge pusher plate 68 moves forward, the projecting arm 74 extending forwardly therefrom bends the trailing top flap downwardly about the horizontal scoreline **28*i*. The leading top flap is brought into contact with the stationary rail 76 and is thus caused to be bent downwardly about the horizontal scoreline 28*j***.

Once the discharge pusher plate 68 contacts the limit switch 78, and so long as a case has contacted the limit switch 82, the upper and lower sets of glue guns 80 are actuated, spraying streams of glue to form parallel rows of glue along each of the bottom and top pairs of longitudinal flaps.

Thereafter, the top side flaps contact the upper converging rails 88 and are urged downwardly about the scorelines **28*k* and 28*l*, while the bottom side flaps contact the lower converging rails 90 and are thus urged upwardly about the scorelines 28*g* and 28*h*. The folding is completed as the bottom flaps traverse up the ramp 96. Thereafter, top and bottom sealing is completed when the case becomes vertically confined by the upper and lower rollers 92 and 94**, to thereafter be discharged onto any suitable conveyor system (not shown).

At the predetermined distance before the end of the forward stroke, the pusher plate 68 contacts the limit switch 84 which causes the plate to return provided the overhead caser has indicated that there are enough containers ready to fill the next case. Otherwise, the pusher plate 68 will continue forward until it contacts the limit switch 79, which will thereupon cause the plate to return. As a point along the return stroke a predetermined distance from the end thereof, the pusher plate 68 contacts a limit switch 91 which causes the pusher plate 68 to stop until the caser 25 has completed its loading cycle of a case. When the caser 25 is in the uppermost position, the cylinder 72 moves the pusher plate 68 the remainder of the returning stroke, along with moving the cam 67 to cause the rotator 52 to rotate 90 degrees, aligning the next case to be loaded with the flap closing and gluing section 20.

INDUSTRIAL APPLICABILITY

It should be apparent that the invention provides an automated, compact and efficient corrugated box packaging system, wherein any conventional caser 25 may be adapted thereto to cooperate with corrugated blanks being formed into boxes, filled by the caser, and then sealed into a completed package for shipment.

While but one embodiment of the invention has been shown and described, other modifications thereof are possible.

I claim:

1. A machine for setting up corrugated box blanks having four side panels folded double and sealed along their otherwise adjacent free edges, with top and bottom flaps extending from each end of each side panel, said machine comprising framework, a magazine mounted on said framework for holding a plurality of said folded blanks, means mounted on said framework for removing individual blanks from the magazine and opening each into a vertically oriented four-sided tube, first transfer means mounted on said framework for moving each of said tubes laterally while closing the bottom trailing end flap thereof, means rotatably mounted on said framework for closing the bottom leading end flap to thus form an open-topped box while breaking the bottom side flaps and then rotating said open-topped box to a loading position, loading means mounted on said framework for depositing product into each open-topped box, a stationary rail and upper and lower pairs of converging guide rails mounted on said framework, second transfer means mounted on said framework for moving each of said loaded boxes off of said rotatably mounted means while closing the top trailing end flap and causing the top leading end flap to contact said stationary rail and bend into a closed position and causing the top and bottom side flaps to contact and travel along said upper and lower pairs of converging rails, means mounted on said framework for depositing an adhesive along each of the top and bottom oppositely disposed side flaps while said boxes are being moved, and means mounted on said framework for compressing said top and bottom side flaps onto the respective top and bottom leading and trailing end flaps to complete the sealing of said boxes, ready for discharge from said machine.

2. The machine described in claim 1, wherein said opening means includes a swing arm pivotally mounted on said framework, and at least one suction cup secured to the distal end of said swing arm for engaging one of the side panels of said blank and causing said one of the side panels to pivot through a 90° arc with said swing arm to thus become the trailing side panel at the first transfer position while opening said blank into a vertically oriented tube.

3. The machine described in claim 2, wherein said first transfer means includes a rail mounted on said framework, a first pusher plate slidably mounted on said rail and adapted to being contacted by said one of the side panels, limit switch means operatively connected to said swing arm for causing said pusher plate to move said tube along said rail, and a forwardly extending projection formed on said first pusher plate for bending the trailing bottom flap into its closed position prior to the closing of the bottom leading flap.

4. The machine described in claim 3, wherein said rotator means includes four 90° spaced support arms, one of said support arms being aligned in its rest position with said rail and having a top surface aligned with the bottom surface of said closed bottom flap, thereby serving to bend the leading bottom flap into a closed position upon the latter's being brought by said first pusher plate into contact with and moved onto said one of said support arms, converging guide rails mounted beneath each of said support arms for breaking the bottom side flaps while said leading bottom flap is being closed, and cam means for indexing said one of said support arms through three ninety degree increments to said loading position.

5. The machine described in claim 4, wherein said loader means is a caser mounted on said framework so as to vertically lower a predetermined amount of product into said box at said loading position.

6. The machine described in claim 5, wherein said second transfer means includes a stationary platform, a second pusher plate for moving the loaded box from said support arm at said loading position onto and along said stationary platform, a forward extending arm formed on said second pusher plate for bending the trailing top flap into its closed position, and said upper and lower pairs of converging guide rails having the forward ends thereof diverging toward said support arm, the center portions thereof parallel adjacent said stationary platform, and the rear ends thereof converging, to thereby bend the top and bottom side flaps into partially closed attitudes.

7. The machine described in claim 6, wherein said adhesive depositing means lays a line of adhesive along the length of each of the top and bottom side flaps on the respective inside surfaces thereof.

8. The machine described in claim 7, wherein said closing means includes a ramp for completing the closing of the adhesive treated bottom side flaps onto the bottom leading and trailing flaps, and upper and lower conveyor rollers completing the closing of the adhesive-treated top side flaps onto the top leading and trailing flaps, and compressing the flaps together to complete the sealing together thereof, ready for discharge.

9. A machine for setting up corrugated box blanks having four side panels folded double and sealed along their otherwise adjacent free edges, with top and bottom end flaps extending from each end of each side panel, said machine comprising framework, said framework having mounted thereon a magazine for holding a plurality of said folded blanks, suction cup means for removing individual blanks from the magazine and opening each into a vertically oriented four-sided tube, first pusher plate means for moving each of said tubes laterally while closing the bottom trailing end flap thereof, loading means for depositing product into the open-topped boxes, rotatable support means for closing the bottom leading end flap to form an open-topped box while breaking the bottom side flaps and then rotating said open-topped box through three ninety degree increments to a loading position, second pusher plate means for moving each of said loaded boxes off of said rotatable support means perpendicular to the path of said first transfer means, and stationary rail means associated with said second pusher plate means for closing the top leading and trailing end flaps and closing the top side flaps, gun means for depositing an adhesive along each of the top and bottom oppositely disposed side flaps while said boxes are being moved, and ramp and roller means for compressing said top and bottom side flaps onto the respective top and bottom leading and trailing end flaps to complete the sealing of said boxes, ready for discharge from said machine.

* * * * *